US005377887A

United States Patent [19]

Garcia

[11] Patent Number: 5,377,887

[45] Date of Patent: Jan. 3, 1995

[54] MULTI-PURPOSE LUGGAGE CONVERTIBLE FROM A BACKPACK TO A HANDBAG

[76] Inventor: Lawrence Garcia, 4542 Mimosa Dr., Yorba Linda, Calif. 92686

[21] Appl. No.: 90,301

[22] Filed: Jul. 12, 1993

[51] Int. Cl.[6] ..... A45F 4/02

[52] U.S. Cl. ..... 224/153; 224/209; 224/151; 294/141; 294/152

[58] Field of Search ..... 224/153, 209, 215, 151, 224/259; 383/4, 16; 294/141, 142, 152

[56] References Cited

U.S. PATENT DOCUMENTS

| | | | |
|---|---|---|---|
| 3,019,952 | 2/1962 | Brewster | 224/209 |
| 3,746,066 | 7/1973 | McIntyre | 150/33 |
| 3,802,613 | 4/1974 | Droeger | 224/153 |
| 4,082,208 | 4/1978 | Lane, Jr. | 224/209 |
| 4,609,084 | 9/1986 | Thomas | 224/259 |
| 4,655,343 | 4/1987 | Lane et al. | 224/153 |
| 4,706,856 | 11/1987 | Jacober | 224/151 |
| 4,810,102 | 3/1989 | Norton | 383/4 |
| 4,883,207 | 11/1989 | McArthur | 224/153 |
| 4,901,897 | 2/1990 | Briggs | 224/153 |
| 4,961,522 | 10/1990 | Weber | 224/151 |
| 5,022,574 | 6/1991 | Cesari | 224/153 |

FOREIGN PATENT DOCUMENTS

| | | | |
|---|---|---|---|
| 60014 | 1/1925 | United Kingdom | 224/215 |

*Primary Examiner*—Ernest G. Cusick
*Assistant Examiner*—David J. Walczak
*Attorney, Agent, or Firm*—Michael A. Kondzella

[57] ABSTRACT

Multi-purpose luggage, convertible from a backpack to a handbag, by turning the luggage inside-out, has a plurality of walls, including a peripherally-disposed, laterally-arranged side wall, a top wall, and a bottom wall. The side wall incorporates a longitudinally-arranged closable opening. Each of the walls has two faces. A pair of manually-grippable handles are secured to one face of the side wall and are complementarily disposed on opposite sides of the opening. A pair of shoulder straps are secured to the opposite face of the side wall. One end of the shoulder straps is secured to the side wall adjacent to the top wall and the other end of the shoulder straps is secured to the side wall adjacent to the bottom wall.

18 Claims, 8 Drawing Sheets

MULTI-PURPOSE LUGGAGE CONVERTIBLE FROM A BACKPACK TO A HANDBAG

BACKGROUND OF THE INVENTION

1. Field of the Invention

This invention relates to multi-purpose utility bags that are convertible from a use as a backpack to a hand-carried bag.

2. Description of the Prior Art

Outdoor activities such as skiing, hiking, cycling, mountain-biking, mountain climbing, and such activities have greatly increased in popularity in the last few years due to realization that such physical activities are a key element in maintaining good health and fitness. Along with such increased activities, a great demand has arisen for rugged tote bags, such as a handbag, hand-luggage, backpacks, and the like, for carrying outdoor gear, a change of clothing, shoes, food, beverages, fishing gear, guns, bullets, and the like. A similar demand for multi-purpose bags has also followed this demand. Athletic clothing and shoes are readily carried in the handbag, and after changing from more formal work clothing into athletic gear, the formal clothing and shoes can be conveniently stored in the bag when it is converted into a backpack for toting not only the remainder of the outdoor gear, but for carrying the pack over your shoulders and on your back thereby freeing one's hands for fishing, shooting, biking, hiking, skiing, or running.

Further, in the traditional arrangement, suitcases, or handbags, have a manually engageable carrying handle on the top, or upper portion, thereof. Such an arrangement provides a convenient means for lugging such a bag for relative short distances as such can be easily manually engaged and disengaged. One of the great inconveniences of such a handle involves eliminating the use of one of the person's hands for other uses. Another difficulty encountered in the use of such a handle is the unbalanced distribution of the weight of the handbag on one side of the body which places great stress and strain on the arm, shoulder and upper back. As a result, the user carrying the bag by such a handle is forced to continually stop and change the bag from one hand to the other so as to not overtax one hand, arm, shoulder and upper back vs the other hand, arm, shoulder and upper back. For these reasons, such a bag can only be transported over relatively short distances.

Because of these problems, shoulder straps are preferred, especially when transporting such a bag over considerable distances. The use of shoulder straps allows the hands to be freed for other activities and uses and the weight thereof is carried by the shoulder and the upper back.

Various types of convertible utility bags are well known in the prior art.

One such type of convertible utility bag is found in U.S. Pat. No. 3,019,952 (Brewster) which discloses a packsack with a pair of shoulder straps which are adapted to be manipulated to form handbag handles. In the particular invention taught by Brewster, when the bag is to be used as a backpack the straps function as shoulder straps and when the bag is adapted for use as a piece of luggage, the shoulder straps are unbuckled, each one then passed through a pair of other straps secured to the outside of the bag, each of which other straps form a loop to receive one of the shoulder straps therethrough to "keep" the shoulder straps to form a handle to be gripped by a person's hand. The requirement for assembly and disassembly of the shoulder straps and feeding it through the straps forming loops on the bag is both inconvenient and time-consuming. Additionally, the shoulder straps are never hidden, but are always exposed to wear because they are always situated on the outside of the bag. Further, in the event that the shoulder straps should break, not only can it not be used as a shoulder strap, but because it is used in a dual-purpose role, it cannot be used as a hand grip when the bag is converted from a backpack to a handbag as well.

Another type of convertible backpack to handbag is depicted in U.S. Pat. No. 3,622,056 issued to Droeger. A rectangularly contoured bag forming a container bag portion 11 with a pair of manually engageable handles 12 is depicted. A panel 16 is provided for accessing the suspension means 14 consisting of a pair of adjustable straps 22 and 23 adapted to fit over and around the shoulders of the user, thereby transforming the handbag into a knapsack. The nature and construction of this convertible backpack to handbag require that the pair of adjustable straps 22 and 23 be anchored to an internal rigid frame 13 (typically, formed of plywood) which, in turn, is secured to the bag 11 in order to serve both as a mount for the suspension means 14 (i.e. the shoulder straps 22 and 23) and as a stiffener for the bag 11. This invention fails to hide the unused manually gripped handles 12 which remain exposed to view and continue to reside on the exterior of the handbag. Further, the internal rigid frame 13 adds weight and consumes valuable storage space within the bag 11.

SUMMARY OF THE INVENTION AND OBJECTS

Fundamentally, the present invention is a multipurpose, convertible backpack to handbag comprising, a bag having a plurality of walls, including a peripherally-disposed, laterally-arranged side wall, a top wall, and a bottom wall, each of said walls having two faces thereto, wherein said side wall incorporates a longitudinally-arranged opening therein, a pair of manually-grippable handles secured to one face of the side wall and complementarily disposed on opposite sides of the longitudinally arranged opening in the side wall of the bag, a pair of shoulder straps, one end of the shoulder straps being secured to the side wall of the bag adjacent to the top wall and the other end of the shoulder straps being secured to the side wall of the bag adjacent to the bottom wall of the bag, and disposed on a face of the side wall opposite from the face of the side wall to which the manually-grippable handles are secured, and a closure means for said longitudinal opening in the bag.

As an added feature, when the present invention is converted for use as a backpack, the shoulder straps are exteriorly presented for use as a backpack and a rearwardly disposed, exteriorly-accessible pocket is also presented for use.

It is one general object of the present invention to provide an improved backpack which is readily convertible to a handbag.

One important and primary object of the instant invention is to provide a combination backpack which may be quickly converted to a handbag by turning the bag inside-out.

Another important and significant object of the invention disclosed herein is to provide a multipurpose utility bag convertible for use as a handbag or as a backpack useful in a wide variety of everyday applications.

A significant and important object of the present invention is to provide a unique combination which is both rugged and lighter in weight than employing a separate handbag and backpack.

A yet still further and primary object of the instant invention is to provide for a convertible handbag to backpack in which the manual grips are concealed from view when the bag is used as a backpack and the shoulder straps are concealed from view when the bag is used as a handbag so as to provide a hand bag of relatively conventional exterior appearance.

Further objects, features and advantages of the instant invention will become apparent from the following description and claims, and from the accompanying drawings, wherein:

DETAILED DESCRIPTION OF THE PREFERRED EMBODIMENT

Figure 1:
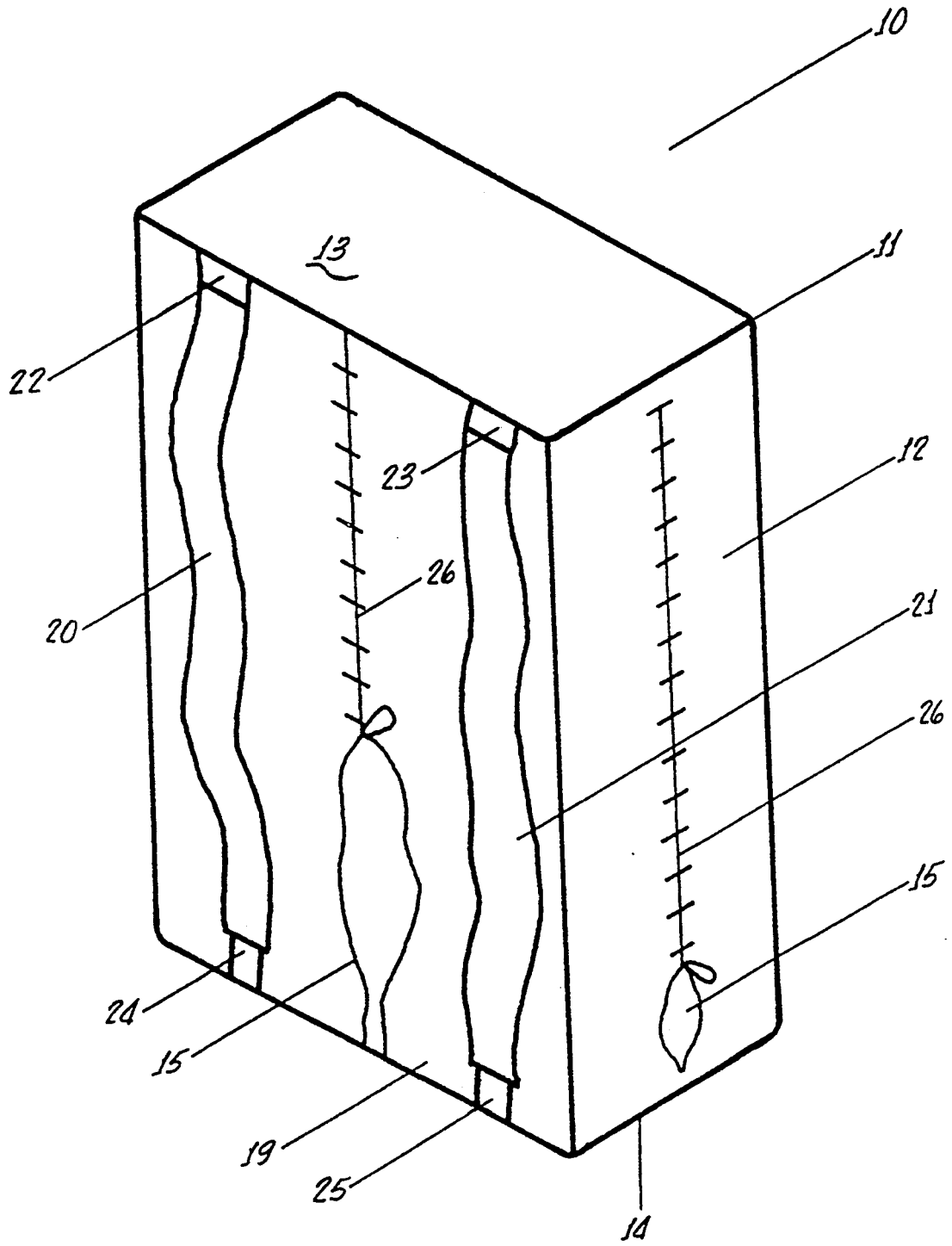
FIG. 1 is a perspective view of the convertible backpack to handbag invention disclosed herein and depicted in its backpack arrangement/mode.
Figure 2:
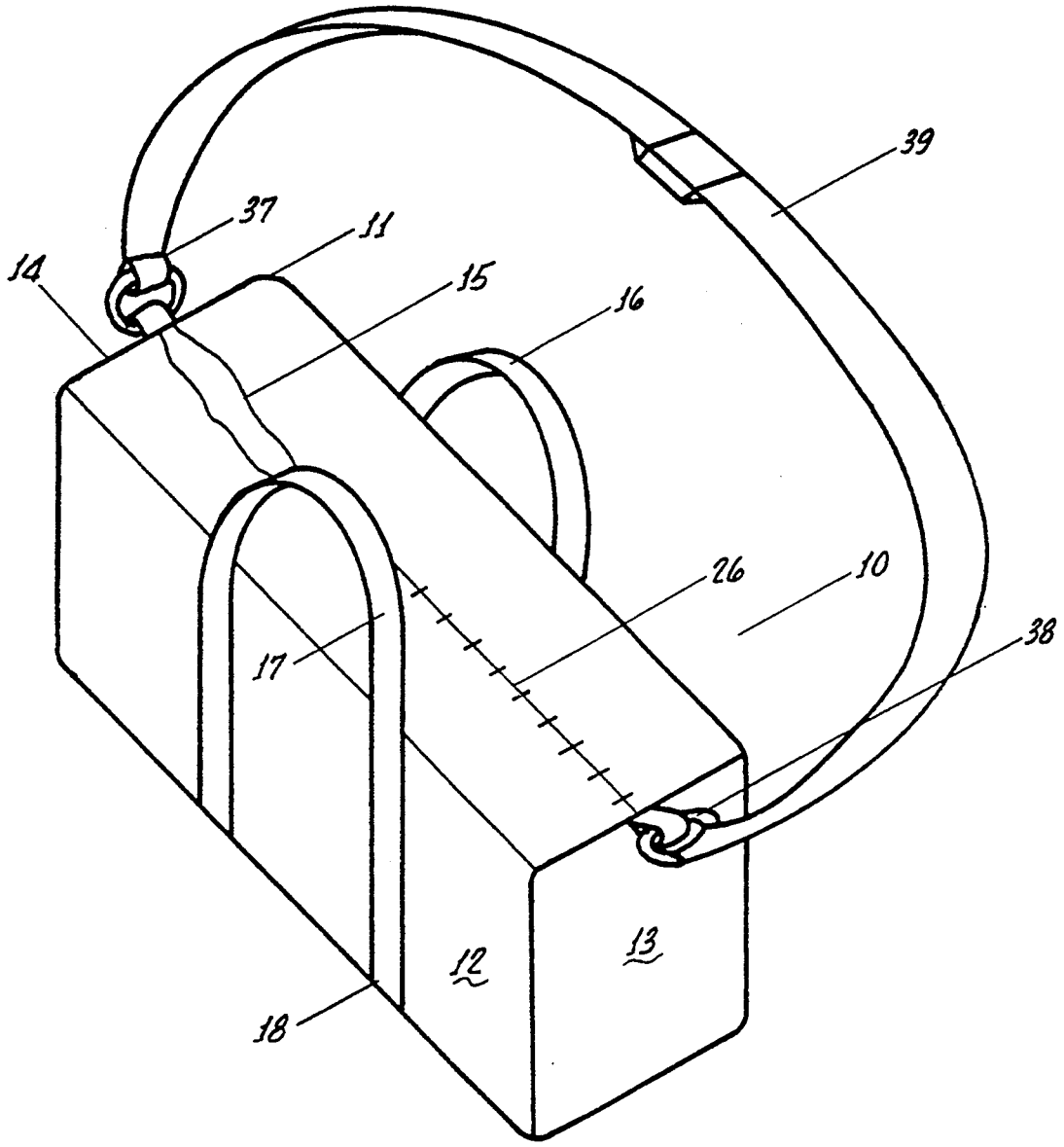
FIG. 2 is a perspective view of the convertible backpack to handbag invention disclosed herein and depicted in its handbag arrangement/mode.

With continuing reference to all of the drawings herein, and with special emphasis now on FIGS. 1 and 2, there is shown a multi-purpose, convertible backpack to handbag, generally indicated at 10, comprising a bag 11 having a plurality of walls, including a peripherally-disposed, laterally-arranged side wall 12, a top wall 13, and a bottom wall 14, each of said walls having two faces thereto, wherein said side wall 12 incorporates a longitudinally-arranged opening 15 therein, a pair of manually-grippable handles 16, 17 secured to one face 18 of the side wall 12 and complementarily-disposed on opposite sides of the longitudinally-arranged opening 15 in side wall 12 of the bag 11, a pair of shoulder straps 20, 21, one end of the complementary ends 22, 23 of the shoulder straps 20, 21 being secured to the bag 11 adjacent to the junction of the top wall 13 and the side wall 12 of the bag 11 and the other respective ends 24, 25 of the shoulder straps 20, 21 being secured to the bag 11 adjacent to the junction of the bottom wall 14 and the side wall 12 of the bag 11, and disposed on the other face 19 of the side wall 12 from the face 18 of the side wall 12 to which the manually-grippable handles 16, 17 are secured; and a closure means 26 for said longitudinal opening 15 in the bag 11.

A top wall 13 is typically formed of an extended portion of the side wall 12 to form a flap to cover the top opening 28 into the bag 11. Removable closure of the flap forming the top wall 13 about the upper rimmed portion 29 of the bag 11 is accomplished by one or more zippers 30, or Velcro tape 31, or other similar closure means.

Figure 5:
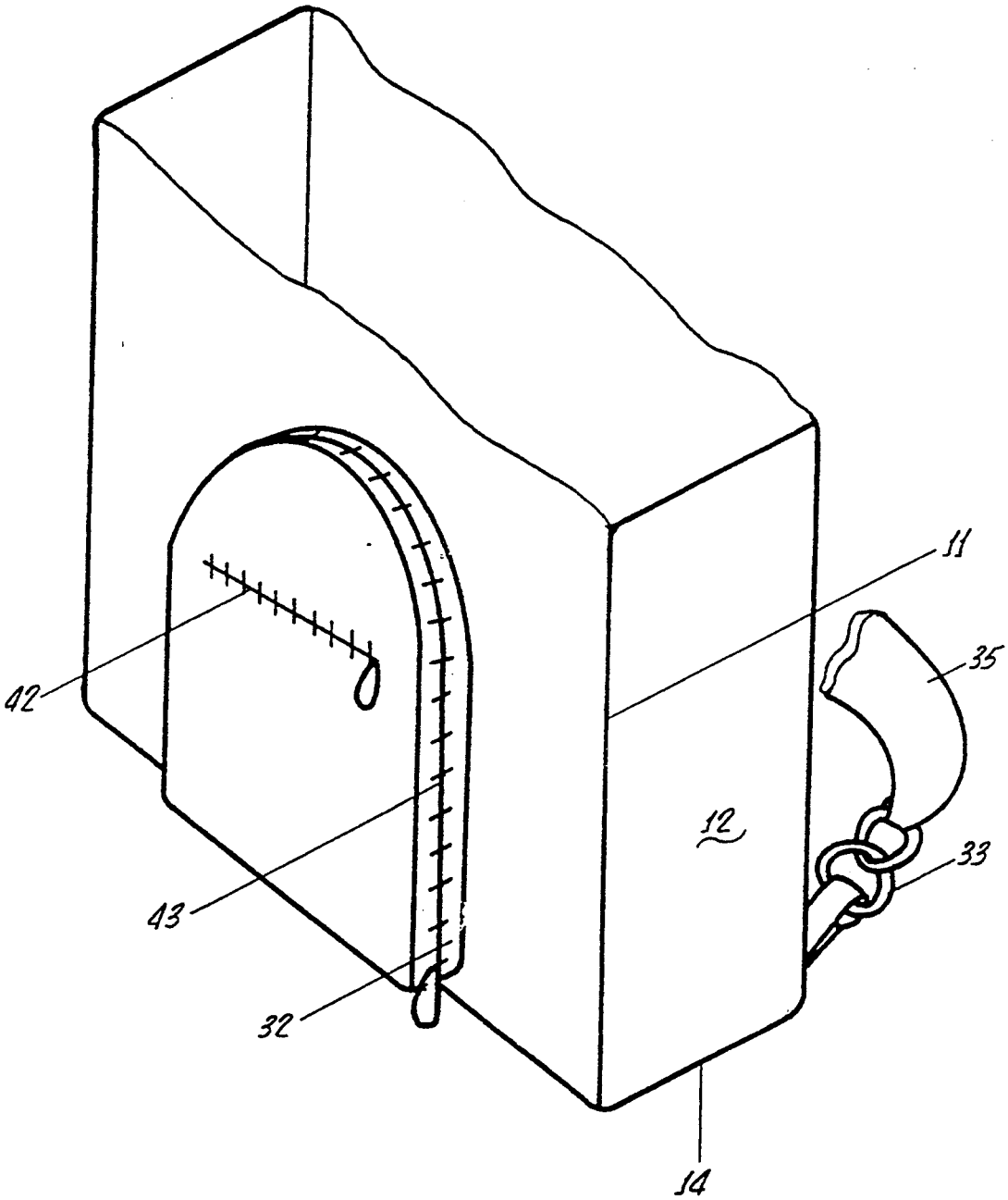
FIG. 5 shows a portion of the rearwardly facing portion of the backpack with an extensible pocket with zippered access.

When the shoulder straps 20, 21 are exteriorly presented for use in the backpack mode, as an added feature, a rearwardly disposed, exteriorly-accessible pocket 32 is provided, as shown in FIG. 5. Typically, such a pocket 32 is presented for use when the bag 11 is converted for use as a backpack. While pocket 32 may represent a separate container from bag 11 per se, pocket 32 may also be usefully configured to allow for ready access by a person other than the person carrying the backpack on his or her shoulders without the necessity of accessing the larger interior of the backpack 10 which is typically only accessible from the top opening 28 by means of a zipper 30 or the like. The pocket 32 may be a flat or an extensible pocket. The pocket 32 may be accessible by way of zippers 42, 43.

BACKPACK ARRANGEMENT AND USE

With continued reference to all of the drawings herein, and with special emphasis now on FIG. 1, there is shown and depicted the present invention arranged for use as a backpack. As shown, the present invention is generally indicated at 10, including a bag 11 having a plurality of walls, including a peripherally-disposed, laterally-arranged side wall 12, a top wall 13, and a bottom wall 14. A longitudinally-arranged opening 15 is provided therein which is conveniently-disposed between the pair of shoulder straps 20, 21 which are secured to one face 18 of the side wall 12.

The pair of shoulder straps 20, 21 are, quite obviously, since they are not now stowed inside of the bag 11, externally presented for use.

Figure 4:
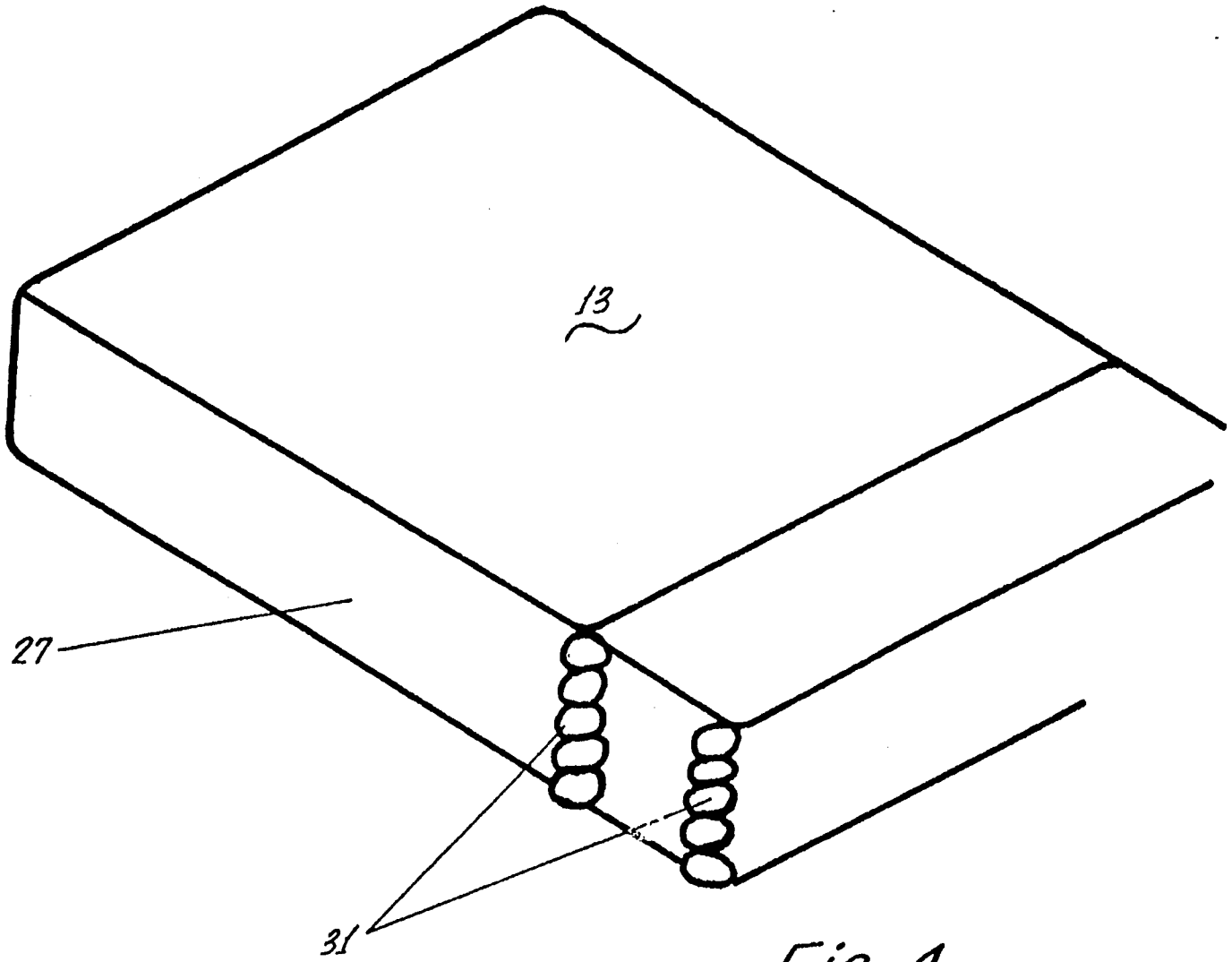
FIG. 4 depicts one alternative arrangement of the top wall 13 with a Velcro hook and pile closure system.

A top wall 13 is typically formed of an extended portion of the side wall 12 to form a flap to cover the top opening 28 into the bag 11. Removable closure of the flap forming the top wall 13 about the upper rimmed portion 29 of the bag 11 is accomplished by one or more zippers 30, or Velcro tape 31, or other similar closure means. When a Velcro hook and pile system 31 is employed as a closure means, it may be desirable to incorporate a flap 27 as shown in FIG. 4 to readily effectuate closure.

When the shoulder straps 20, 21 are exteriorly presented for use in the backpack mode, as an added feature, a pair of anchoring rings 33, 34 are operably secured to the face of the side wall 12 adjacently disposed to the bottom wall 14 to which the shoulder straps 20, 21 are secured, whereby an adjustable strap 35 can be operably and removably secured therebetween for use as a waist belt whereby a portion of the weight in the backpack is borne by the waist of the backpack user instead of the user's shoulders.

It should also be noted that the longitudinally-arranged opening **15*a* may be usefully disposed on any portion of the side wall 12**.

Figure 3:
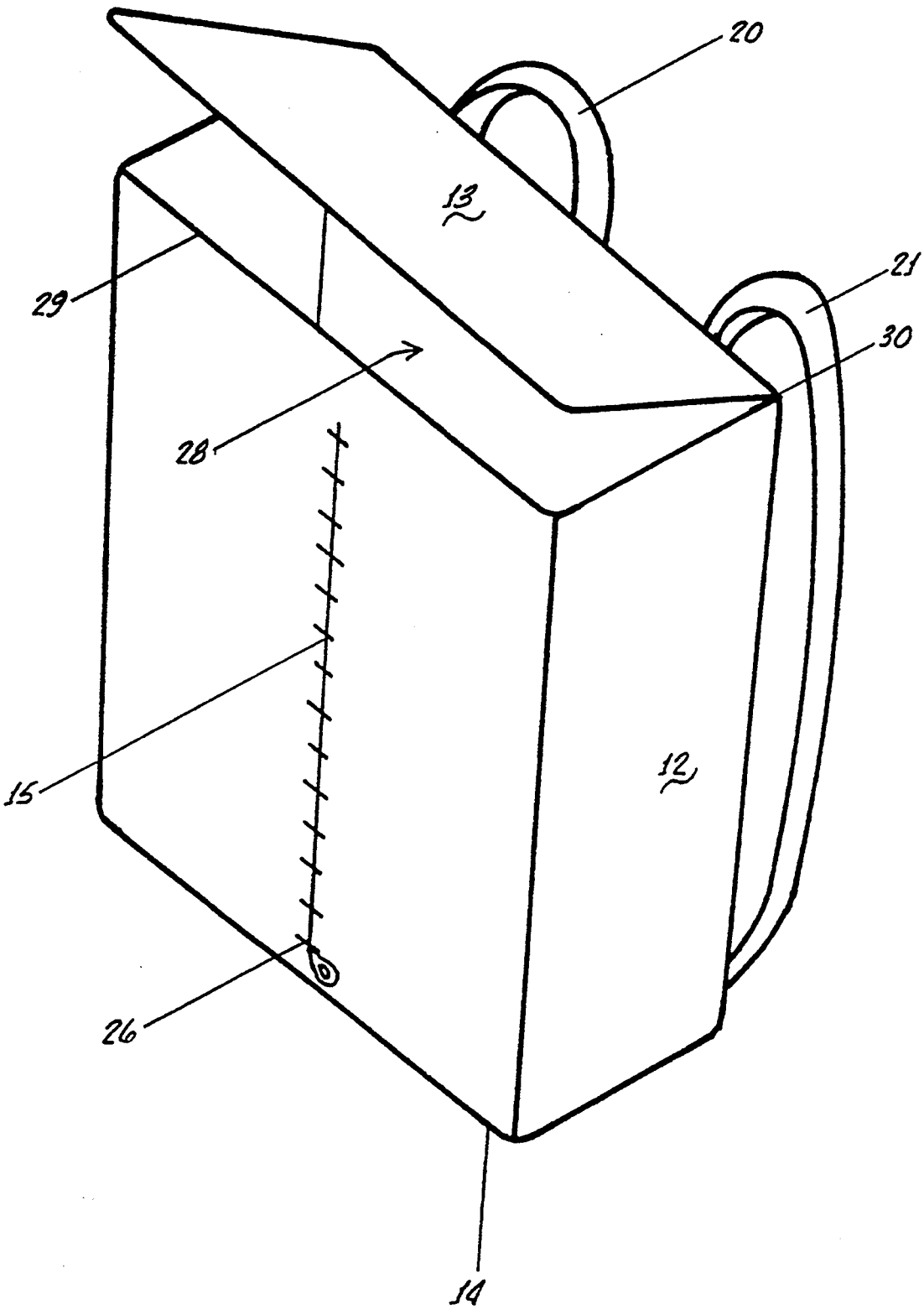
FIG. 3 is a perspective view of the convertible backpack to handbag invention disclosed herein and depicted in its backpack arrangement/mode, shown with the alternative arrangement of a closeable top wall to provide access into the top of the backpack, and a rearwardly facing longitudinally-arranged zippered opening into the backpack.

In yet another embodiment of the present invention as shown in FIG. 3, the longitudinally-arranged opening 15b may be usefully disposed on any portion of the side wall 12 oppositely-disposed to that portion of the side wall 12 to which the shoulder straps 20, 21 are securely mounted.

Figure 6:
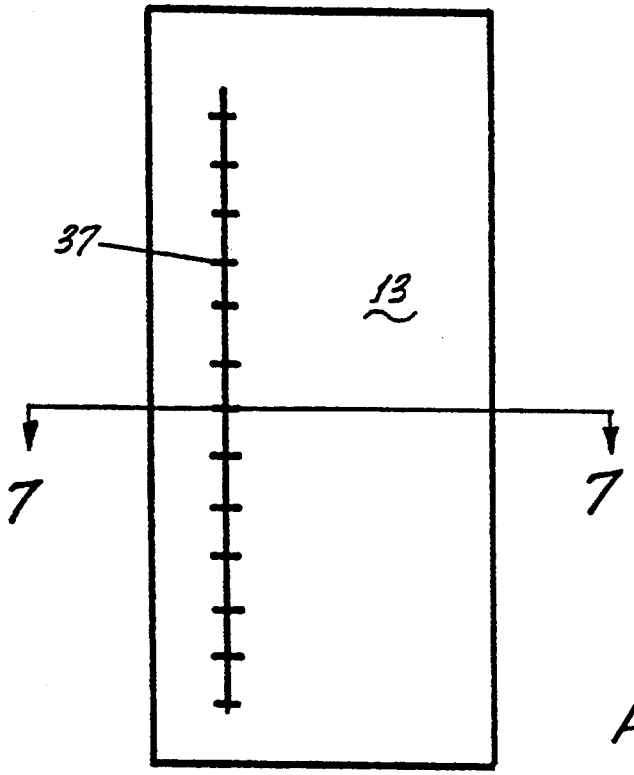
FIG. 6 is a top view of the backpack with zippered access into a pocket built into the top wall forming a flap for the backpack.
Figure 7:
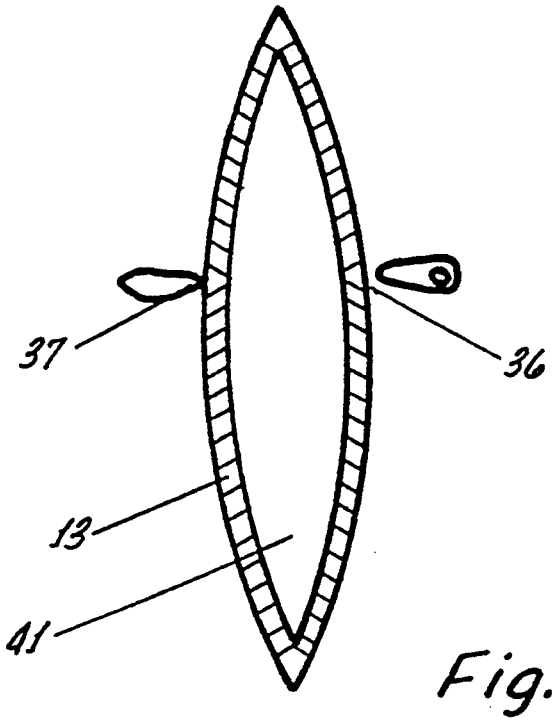
FIG. 7 is a view taken along Plane 7—7 of FIG. 6.
Figure 8:
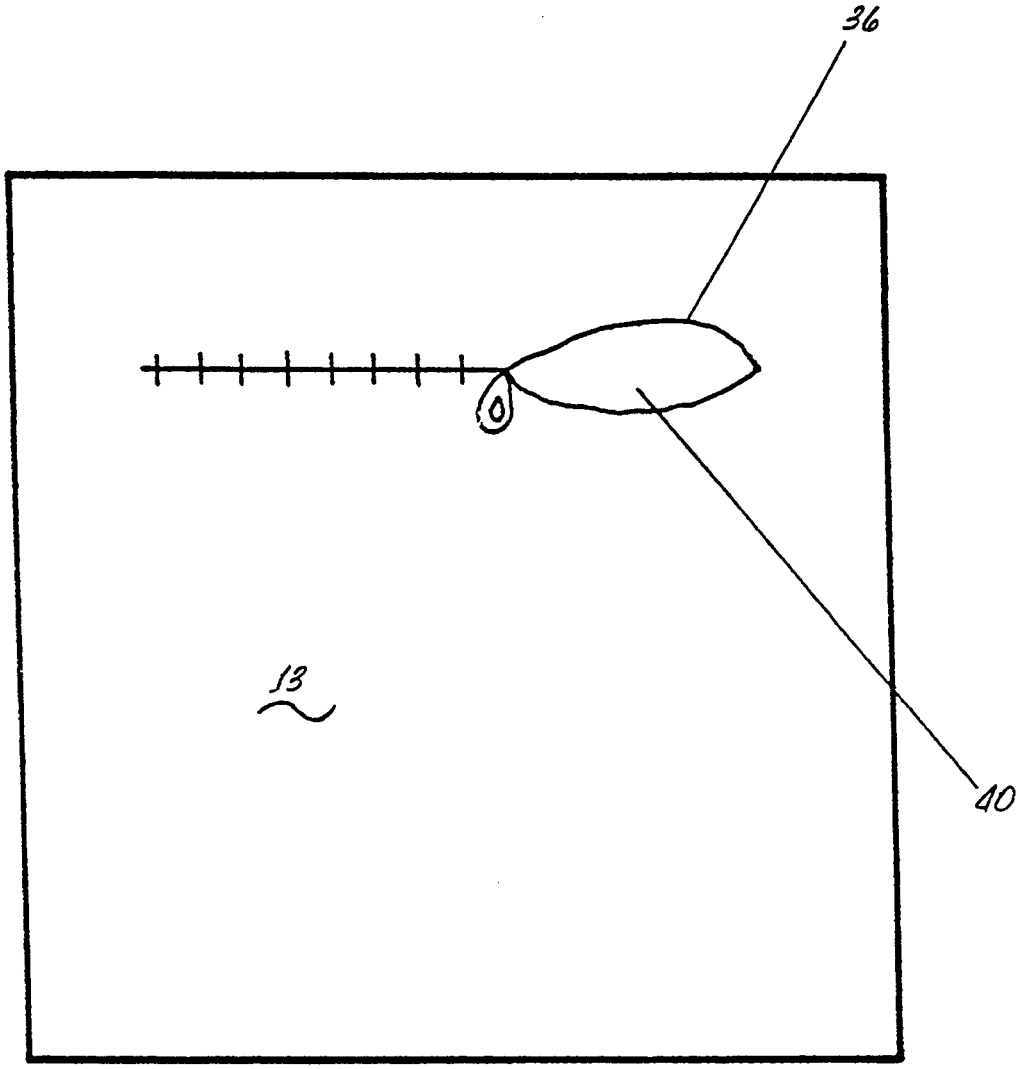
FIG. 8 is a top view of the invention in the handbag mode.
Figure 9:
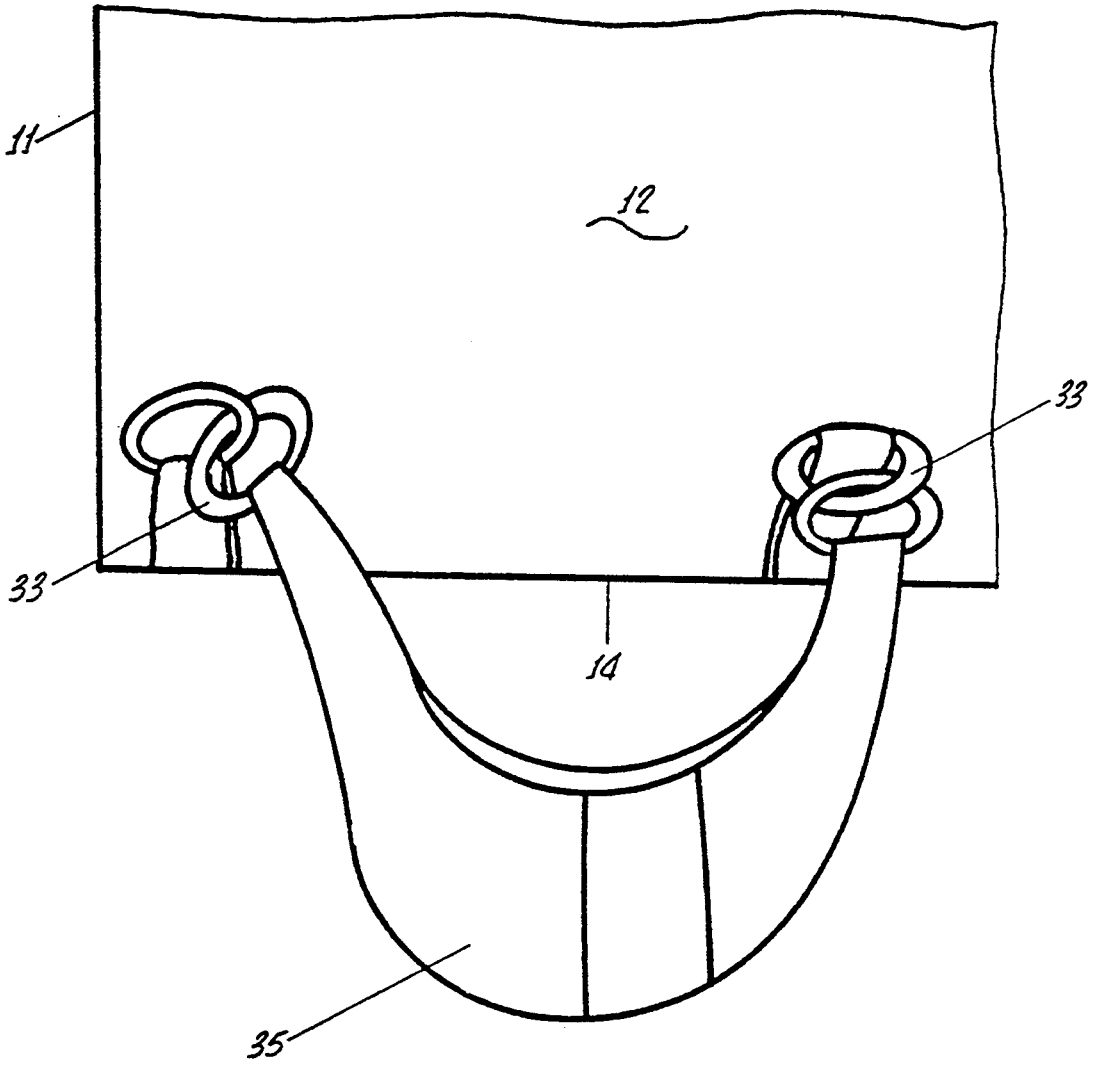
FIG. 9 is a lower bottom view of the side wall to which the adjustable strap which functions as a waist belt is detachably secured.

As depicted in FIGS. 6 and 7, a zippered opening 37 into a pocket 41 in the top wall 13 may be provided for ready access into the pocket 41 from the exterior side when the invention 10 is arranged in the backpack mode.

HAND BAG ARRANGEMENT AND USE

With specific reference now to FIG. 2, there is shown and depicted the present convertible backpack to handbag invention 10 shown in its handbag conversion arrangement/mode. As shown, there are the manually-grippable handles 16 and 17 secured to the peripherally-disposed, laterally-arranged side wall 12, a top wall 13a, and a bottom wall 14a, each of said walls having two sides thereto, wherein said side wall 12 incorporates a longitudinally-arranged opening 15 therein. The pair of manually-grippable handles 16, 17 are secured to one side 18 of the side wall 12 and are complementarily-disposed on opposite sides of the longitudinally-arranged opening 15 in side wall 12 of the bag 11.

A zippered opening 36 into a pocket 40 in the top wall 13a may be provided for ready access into the pocket 40 from the exterior side of the handbag when the invention 10 is arranged in the handbag mode.

Still further, as another convenience, a pair of complementary rings 37, 38 are operably secured to the face of side wall 12 to which the manually-grippable handles 16, 17 are secured adjacent to opposite ends of the longitudinally-arranged, zippered opening 15, whereby an adjustable strap 39 can be removably secured for use as a shoulder strap.

It is understood that the present invention is not limited to the particular construction and arrangement of parts disclosed and illustrated herein, but encompasses all such modified forms thereof as come within the scope of the following claims:

What I claim as my invention is:

1. Multi-purpose luggage comprising a bag, a pair of handles, and a pair of shoulder straps, said bag being convertible, by turning the bag inside-out, between a handbag configuration wherein said pair of handles is outside of said bag and said pair of shoulder straps is inside said bag, and a backpack configuration wherein said pair of shoulder straps is outside of said bag and said pair of handles is inside said bag.

2. Multi-purpose luggage convertible between a handbag and a backpack, by turning the luggage inside-out, comprising:

a peripherally-disposed, laterally-arranged side wall containing a closable, longitudinally-arranged opening therein;

a top wall joined to said side wall; and a bottom wall joined to said side wall;

said side wall, top wall, and bottom wall each having two faces, a handbag face and an oppositely disposed backpack face;

a pair of manually-grippable handles secured to the handbag face of said side wall and complementarily disposed on opposite sides of said opening; and a pair of shoulder straps, one end of said pair of shoulder straps being secured to said backpack face of said side wall adjacent to said top wall and the other end of said pair of shoulder straps being secured to said backpack face of said side wall adjacent to said bottom wall.

3. The multi-purpose luggage of claim 2 wherein said top wall is joined to said side wall by a closure means.

4. The multi-purpose luggage of claim 3 wherein said closure means comprises a zipper.

5. The multi-purpose luggage of claim 3 wherein said closure means comprises Velcro hook and pile closure system.

6. The multi-purpose luggage of claim 2 wherein a pocket is secured to said side wall.

7. The multi-purpose luggage of claim 6 wherein said pocket is extendible from said side wall.

8. The multi-purpose luggage of claim 6 wherein said pocket has an opening equipped with a closure means.

9. The multi-purpose luggage of claim 4 wherein said closure means comprises a zipper.

10. The multi-purpose luggage of claim 8 wherein said closure means is peripherally disposed about said pocket.

11. The multi-purpose luggage of claim 2 wherein said longitudinally arranged opening is equipped with a closure means.

12. The multi-purpose luggage of claim 11 wherein said closure means comprises a zipper.

13. The multi-purpose luggage of claim 2 further including a pair of complementary rings operably secured to the face of the side wall to which said manually-grippable handles are secured and disposed adjacent to the opposite ends of said opening.

14. The multi-purpose luggage of claim 2 further including a complementary pair of rings operably secured to the face of the side wall to which said pair of shoulder straps is secured and disposed adjacent to said bottom wall.

15. The multi-purpose luggage of claim 2 further including a pocket formed in said side wall with an opening thereinto on said handbag face, said pocket having a closure means for the opening into said pocket.

16. The luggage of claim 2 wherein the walls are arranged to be convertible between a handbag configuration in which the handbag faces of said walls are on the outside of the luggage and the backpack faces of said walls are on the inside of the luggage, and a backpack configuration in which the backpack faces of said walls are on the outside the luggage and the handbag faces of said walls are on the inside of the luggage, said shoulder straps being inside the luggage in said handbag configuration and outside the luggage in said backpack configuration, and said handles being outside the luggage in said handbag configuration and inside the luggage in said backpack configuration.

17. Multi-purpose luggage convertible between a handbag and a backpack, by turning the luggage inside-out, comprising:

a peripherally-disposed, laterally-arranged side wall containing a closable, longitudinally-arranged opening therein;

a top wall joined to said side wall; and a bottom wall joined to said side wall;

said side wall, top wall, and bottom wall each having two faces, a handbag face and an oppositely disposed backpack face;

a pair of manually-grippable handles secured to the handbag face of said side wall and complementarily disposed on opposite sides of said longitudinally-arranged opening; and a pair of shoulder straps, one end of said pair of shoulder straps being secured to said backpack face of said side wall adjacent to said top wall and the other end of said pair of shoulder straps being secured to said backpack face of said side wall adjacent to said bottom wall;

said top wall further comprising a pocket with a first opening from said backpack face and with a second opening from said handbag face, said first opening being equipped with a first closure means and said second opening being equipped with a second closure means.

18. The multi-purpose luggage of claim 17 wherein said first and second closure means comprise zippers.

* * * * *